US007501933B2

(12) United States Patent
Rousso et al.

(10) Patent No.: US 7,501,933 B2
(45) Date of Patent: Mar. 10, 2009

(54) INTERACTIVE CUP ASSEMBLY

(75) Inventors: John Rousso, Trumbull, CT (US); Charles J. Renz, Briarcliff, NY (US)

(73) Assignee: Playtex Products, Inc., Westport, CT (US)

( * ) Notice: Subject to any disclaimer, the term of this patent is extended or adjusted under 35 U.S.C. 154(b) by 211 days.

(21) Appl. No.: 11/447,795

(22) Filed: Jun. 6, 2006

(65) Prior Publication Data

US 2006/0277817 A1 Dec. 14, 2006

Related U.S. Application Data

(60) Provisional application No. 60/687,837, filed on Jun. 6, 2005.

(51) Int. Cl.
*G08B 23/00* (2006.01)

(52) U.S. Cl. ..... 340/321; 43/44.2; 206/217; 340/384.7; 340/573.1; 446/81; 446/484

(58) Field of Classification Search ..... 340/573.1, 340/321, 384.1, 384.7, 384.73, 286.09; 220/703; 222/39; 446/297, 397, 81, 484; 43/44.2; 206/217; 215/400
See application file for complete search history.

(56) References Cited

U.S. PATENT DOCUMENTS

| | | | | |
|---|---|---|---|---|
| 4,115,931 | A | 9/1978 | Futhey | |
| 5,004,442 | A | 4/1991 | Lemelson et al. | |
| 5,125,866 | A * | 6/1992 | Arad et al. | 446/397 |
| D354,416 | S | 1/1995 | Cautereels et al. | D7/507 |
| 5,648,129 | A | 7/1997 | Lee et al. | 428/24 |
| 6,020,823 | A * | 2/2000 | DeCicco | 340/691.2 |
| 6,037,872 | A * | 3/2000 | Dunnum | 340/586 |
| 6,419,543 | B1 | 7/2002 | Burrows | |
| 6,443,589 | B1 * | 9/2002 | Lee | 362/101 |
| 6,505,734 | B2 * | 1/2003 | Su | 206/217 |
| 2001/0018809 | A1 * | 9/2001 | Heropoulos et al. | 40/544 |
| 2001/0032698 | A1 | 10/2001 | Bottari | |
| 2004/0116036 | A1 | 6/2004 | Nugent et al. | |
| 2005/0069695 | A1 | 3/2005 | Jung et al. | |
| 2007/0093169 | A1 | 4/2007 | Blaszczyk et al. | |

OTHER PUBLICATIONS

International Search Report dated Sep. 26, 2007 for International Application No. PCT/US2006/21926.
Written Opinion dated Sep. 26, 2007 for International Application No. PCT/US2006/21926.

* cited by examiner

*Primary Examiner*—Brent Swarthout
(74) *Attorney, Agent, or Firm*—Ohlandt, Greeley, Ruggiero & Perle, LLP.

(57) ABSTRACT

A cup assembly is provided. The cup assembly is interactive by providing stimuli when the cup body is pressed by a user. The cup can provide sound emitted from an electronics module in a bottom cap. The cup body can use conductive ink to create a circuit for actuation of the sound.

20 Claims, 11 Drawing Sheets

INTERACTIVE CUP ASSEMBLY

RELATED APPLICATION

This application is related to and claims priority in, copending U.S. Provisional Application Ser. No. 60/687,837, filed Jun. 6, 2005, the disclosures of which are incorporated herein by reference.

BACKGROUND OF THE INVENTION

1. Field of the Invention

The present invention relates to infant feeding. More particularly, the present invention relates to a cup.

2. Description of Related Art

Most cups are not interactive at all. They may have graphics on the side and are just vessels for liquids. The spill-proof cups that are interactive only have lights that flash and require a pushbutton to press to make the lights go on. Pushbuttons are difficult to press for a young child.

The cups that are interactive with lights have the batteries and electronics that control the lighting integral to the cup. Batteries that are integrated with the main cup can be a problem. The cup vessel that holds the liquid will often be put into the dishwasher for cleaning or the microwave for heating. The dishwasher heat may degrade battery life and the water can short circuit electronics. The microwave may over-excite the electronics and can make batteries explode.

SUMMARY OF THE INVENTION

It is an object of the present invention to provide a cup assembly that is interactive providing stimuli to the user.

It is another object of the present invention to provide such a cup assembly that makes desired sounds.

It is yet another object of the present invention to provide such a cup assembly where the desired sounds include speech.

These and other objects and advantages of the present invention are provided by a cup assembly having conductive ink lines that can be bridged or shorted by the touching of a user so that the lines complete a circuit and actuate a sound emitting device. The sound emitted is preferably speech that is an audio stimuli for the infant.

Other and further objects, advantages and features of the present invention will be understood by reference to the following:

DETAILED DESCRIPTION OF THE INVENTION

Figure 1:
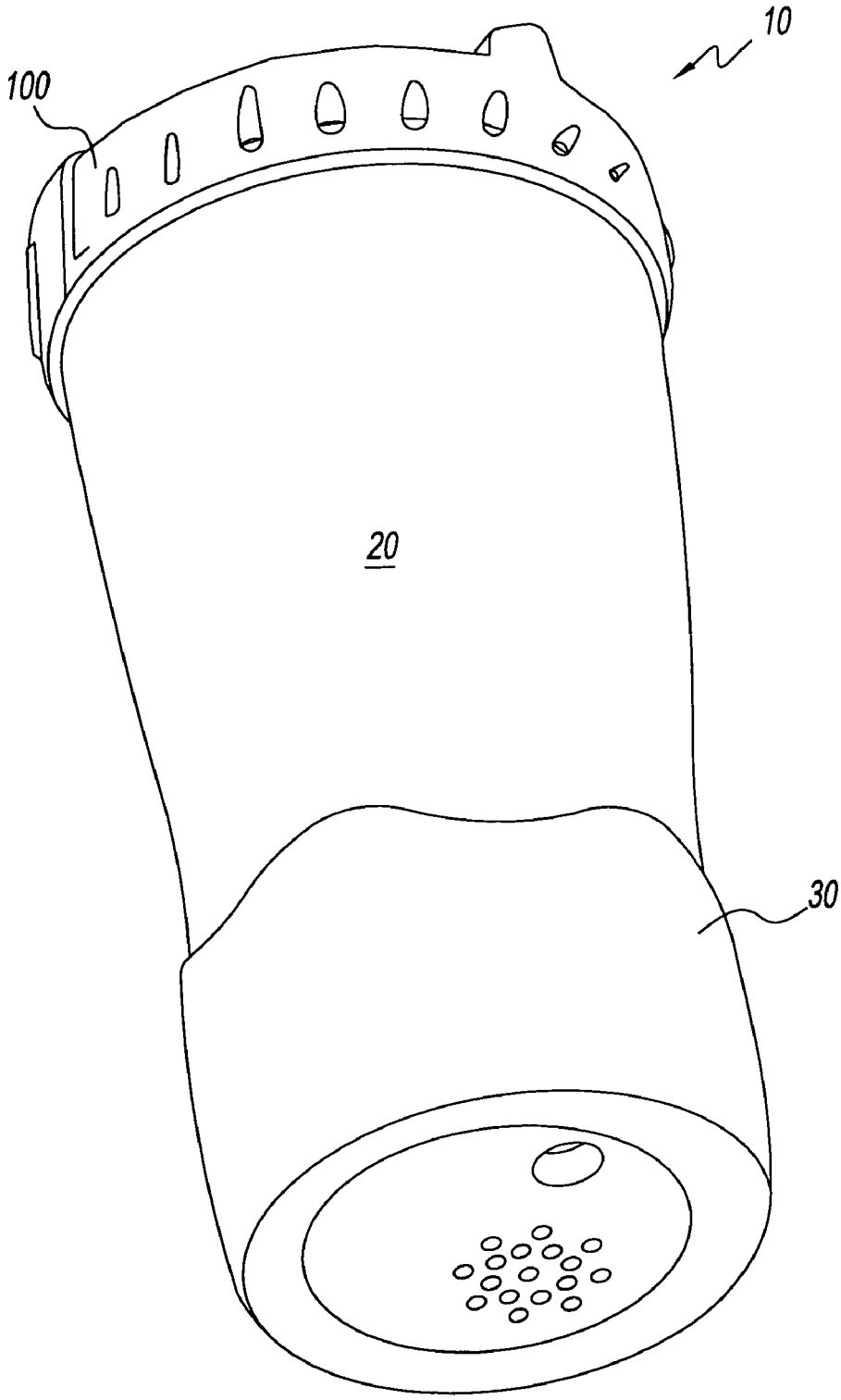
FIG. 1 is a perspective view of a preferred embodiment of the bottle assembly of the present invention.
Figure 1A:
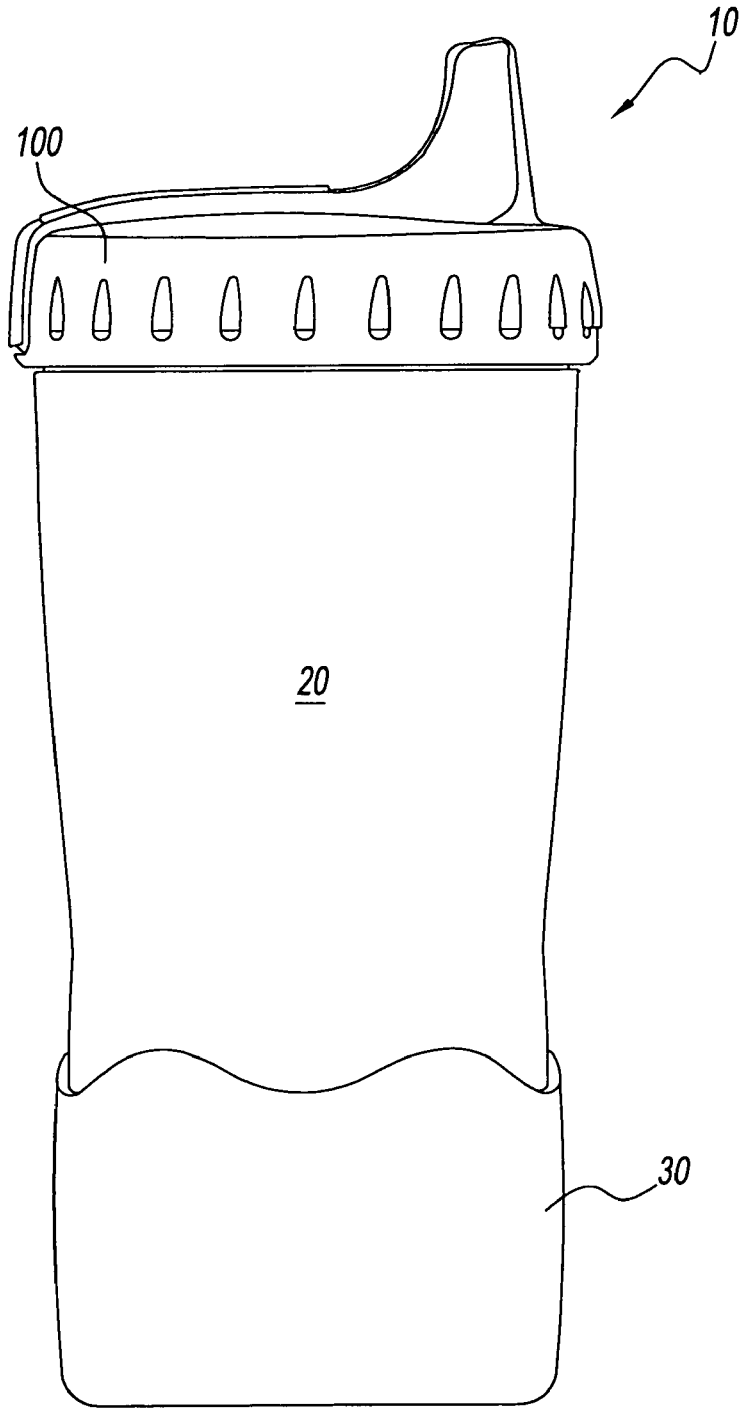
FIG. 1*a* is a perspective view of a preferred embodiment of the bottle assembly of the present invention.

Referring to FIGS. 1 through 11, an exemplary embodiment of an interactive cup is shown and generally referred to by reference numeral 10. The lid 100 and valve 200 allow the cup to be spill proof, while facilitating drinking by an infant. The present invention contemplates the use of various shapes and sizes for the lid 100, as well as various valving mechanisms (or no valving mechanism) 200. The cup 10 is an interactive cup that creates s stimuli, preferably a sound, when you touch a point on the graphics 50.

Figure 2:
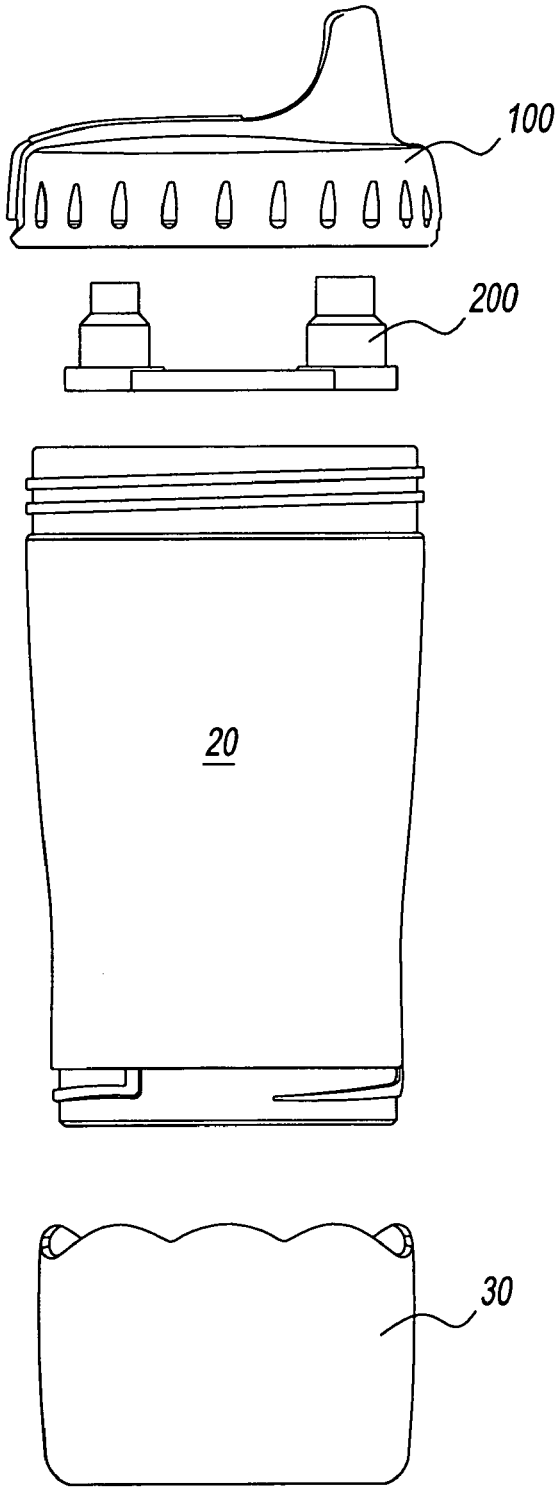
FIG. 2 is an exploded plan view of the bottle assembly of FIG. 1.
Figure 2A:
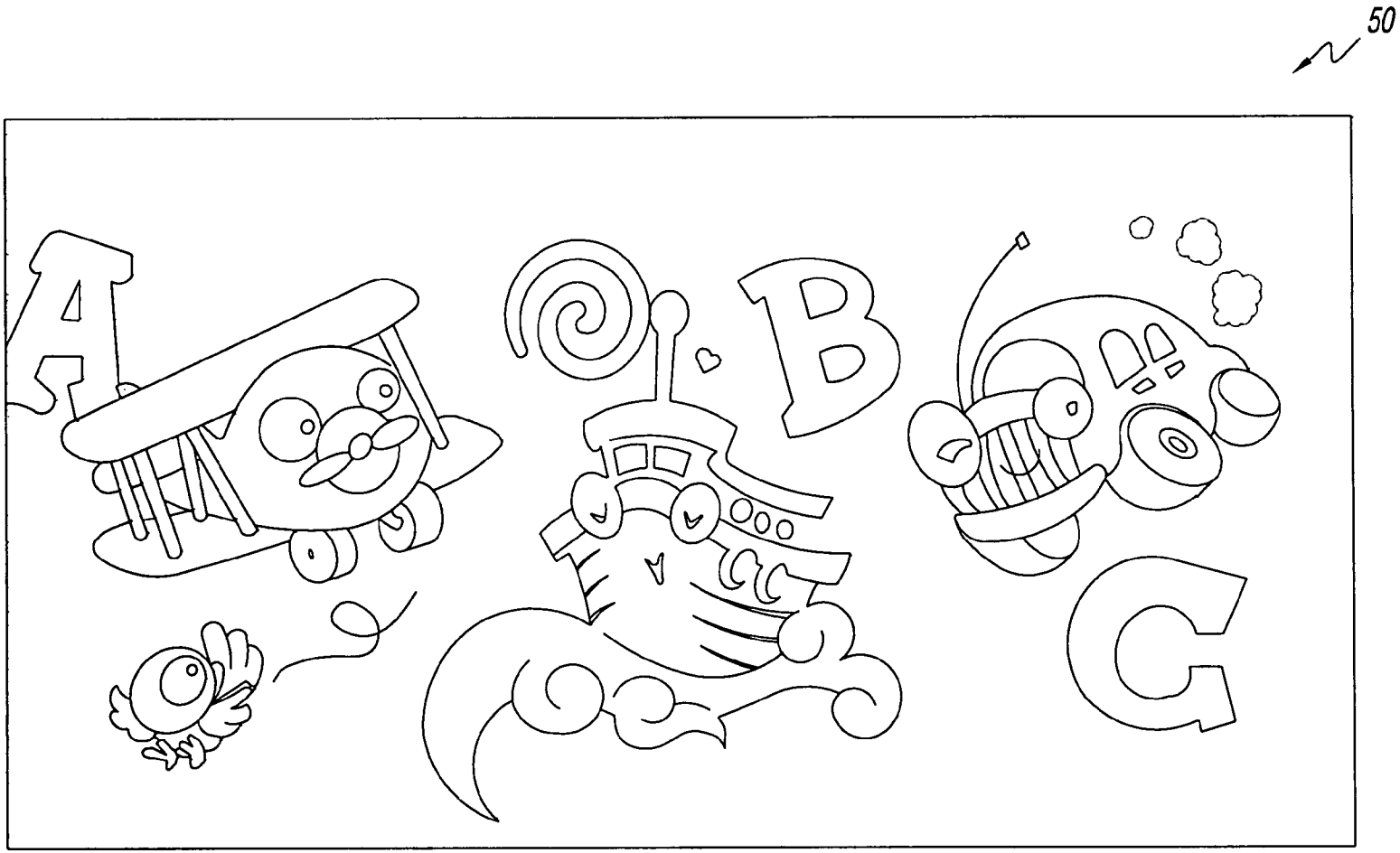
FIG. 2*a* is a various graphics that can be printed on the cup body.
Figure 3:
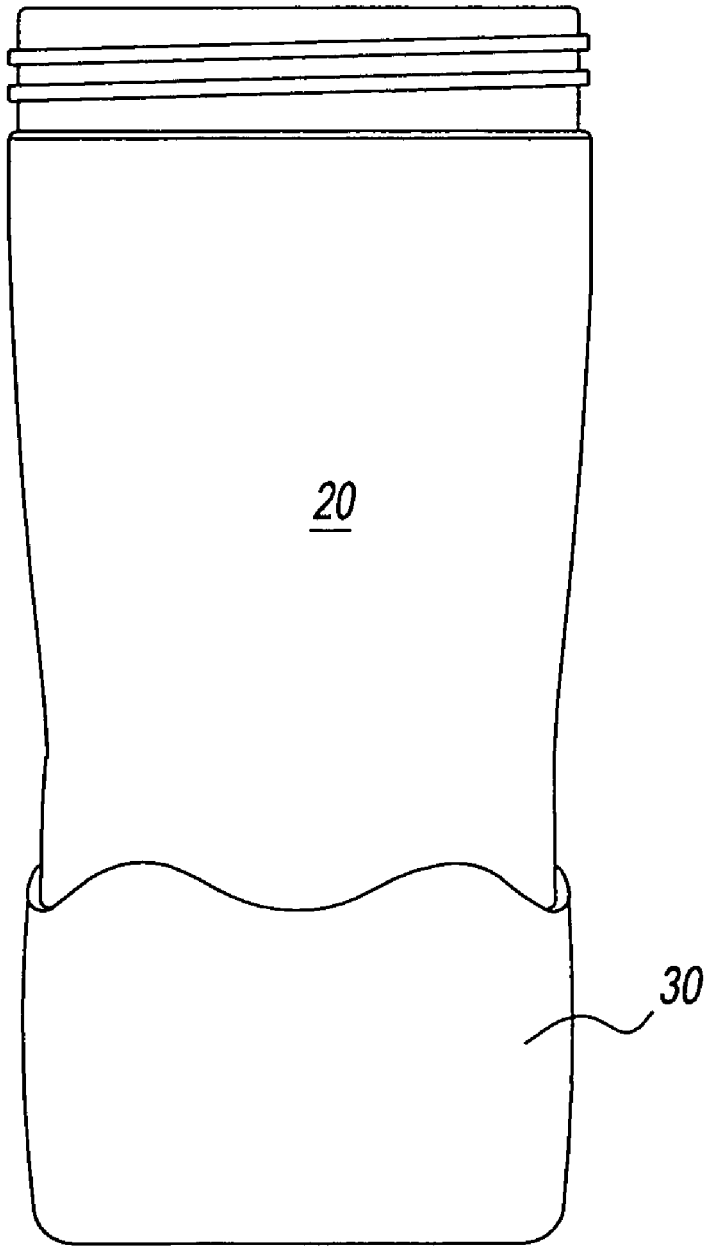
FIG. 3 is a plan view of the cup body and bottom cap of FIG. 1.
Figure 4:
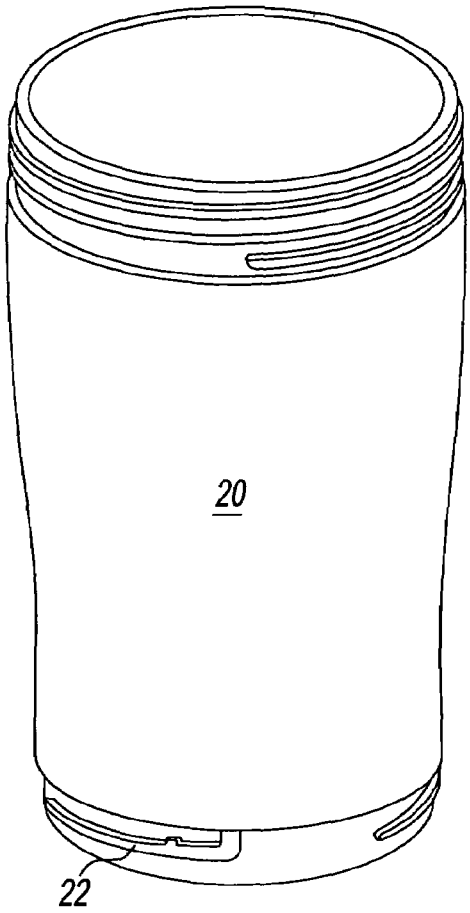
FIG. 4 is a perspective view of the cup body of FIG. 1.
Figure 5:
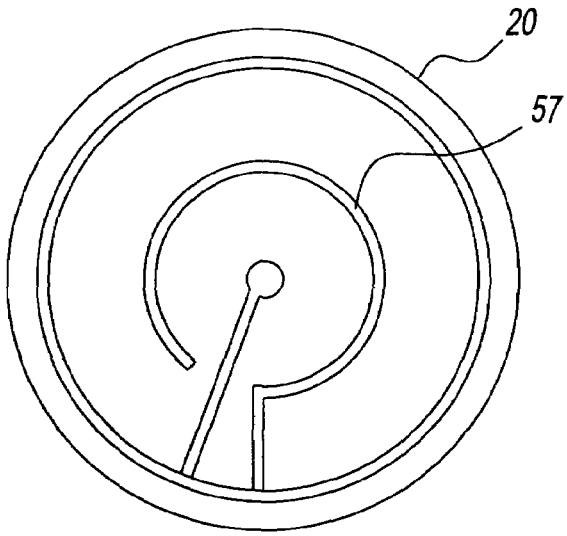
FIG. 5 is a bottom view of the cup body of FIG. 4.
Figure 6:
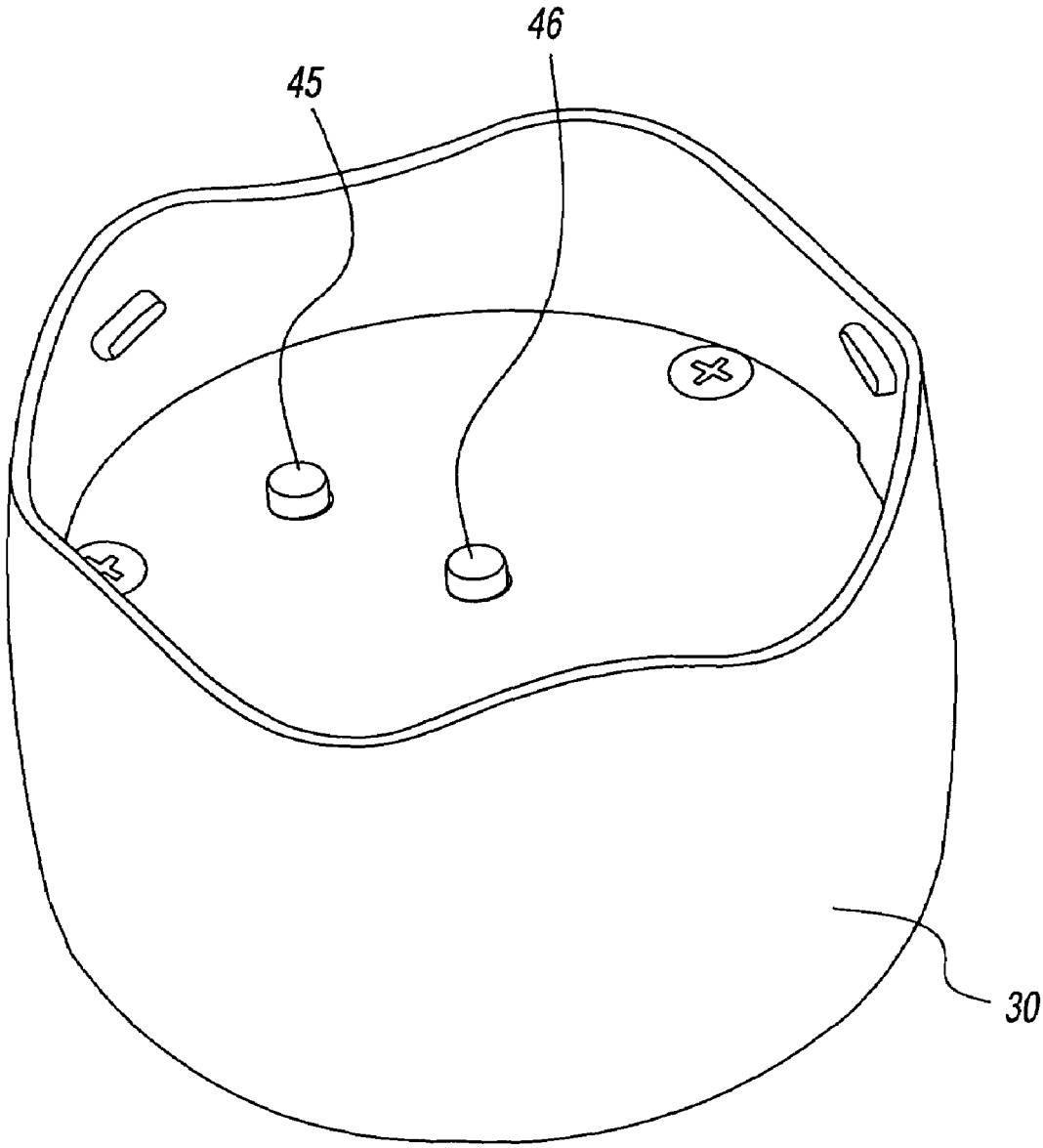
FIG. 6 is a perspective view of the bottom cap of FIG. 1.
Figure 7:
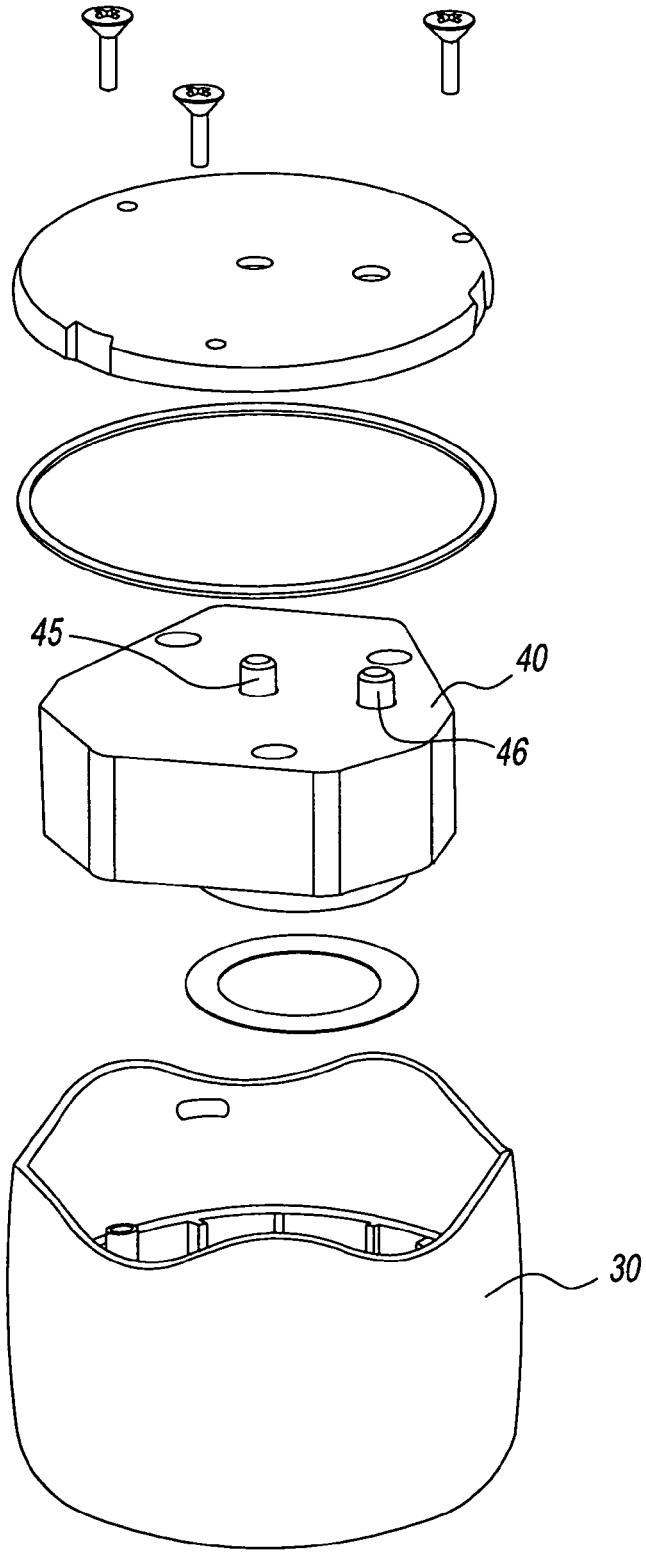
FIG. 7 is an exploded view of the bottom cap assembly of FIG. 6.
Figure 8:
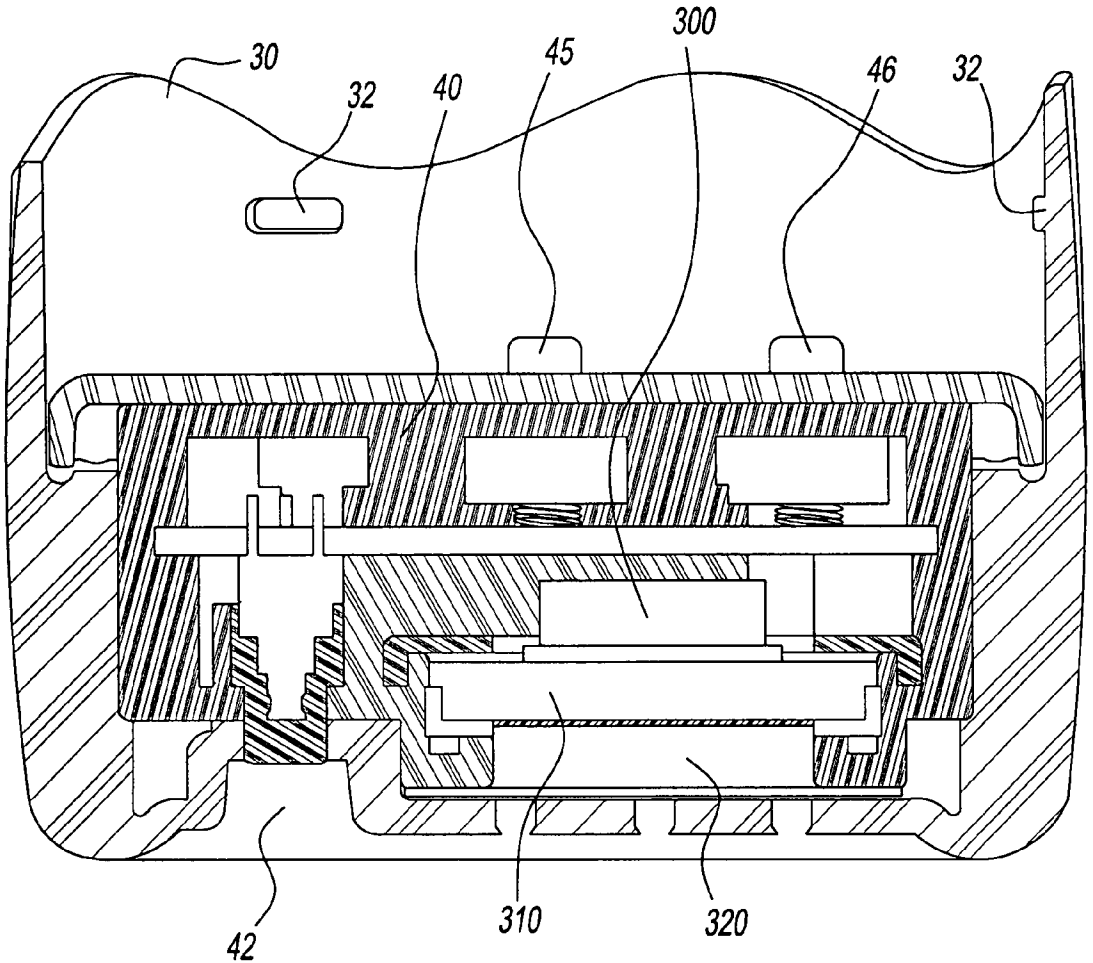
FIG. 8 is a cross-sectional view of the bottom cap assembly of FIG. 7.
Figure 9:
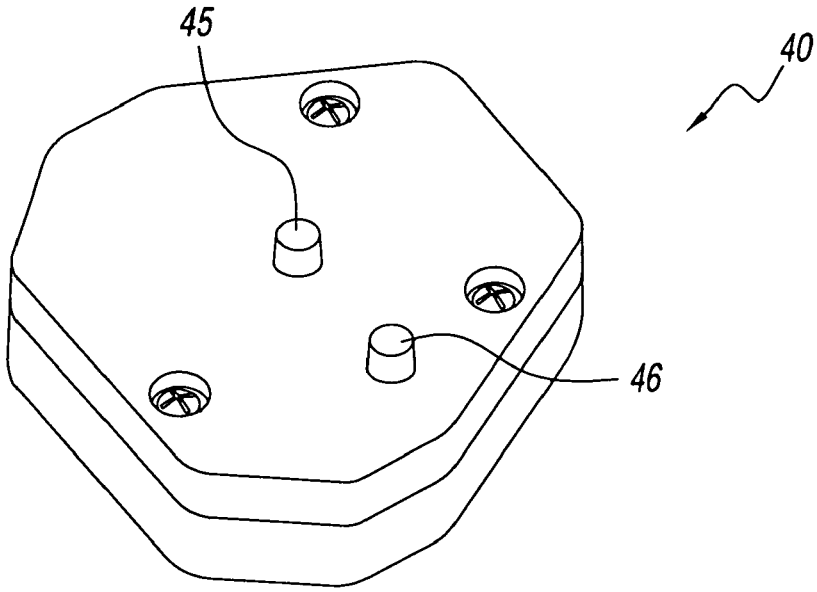
FIG. 9 is a top perspective view of the electronics module.
Figure 10:
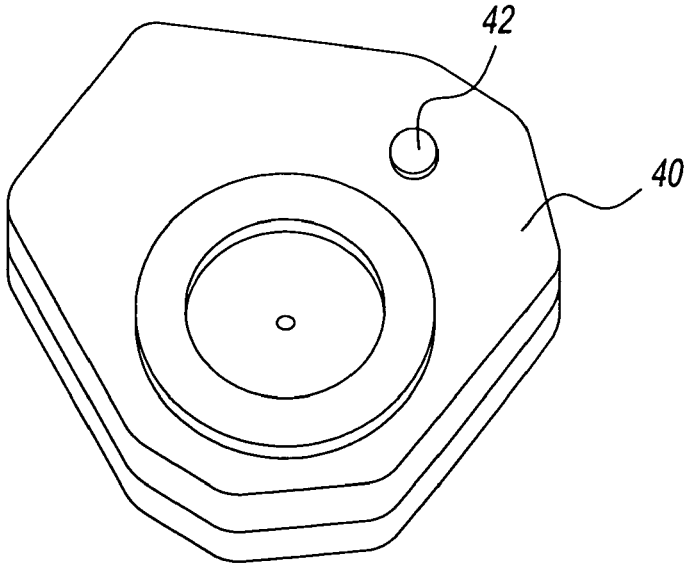
FIG. 10 is a bottom perspective view of the electronics Module of FIG. 9.
Figure 11:
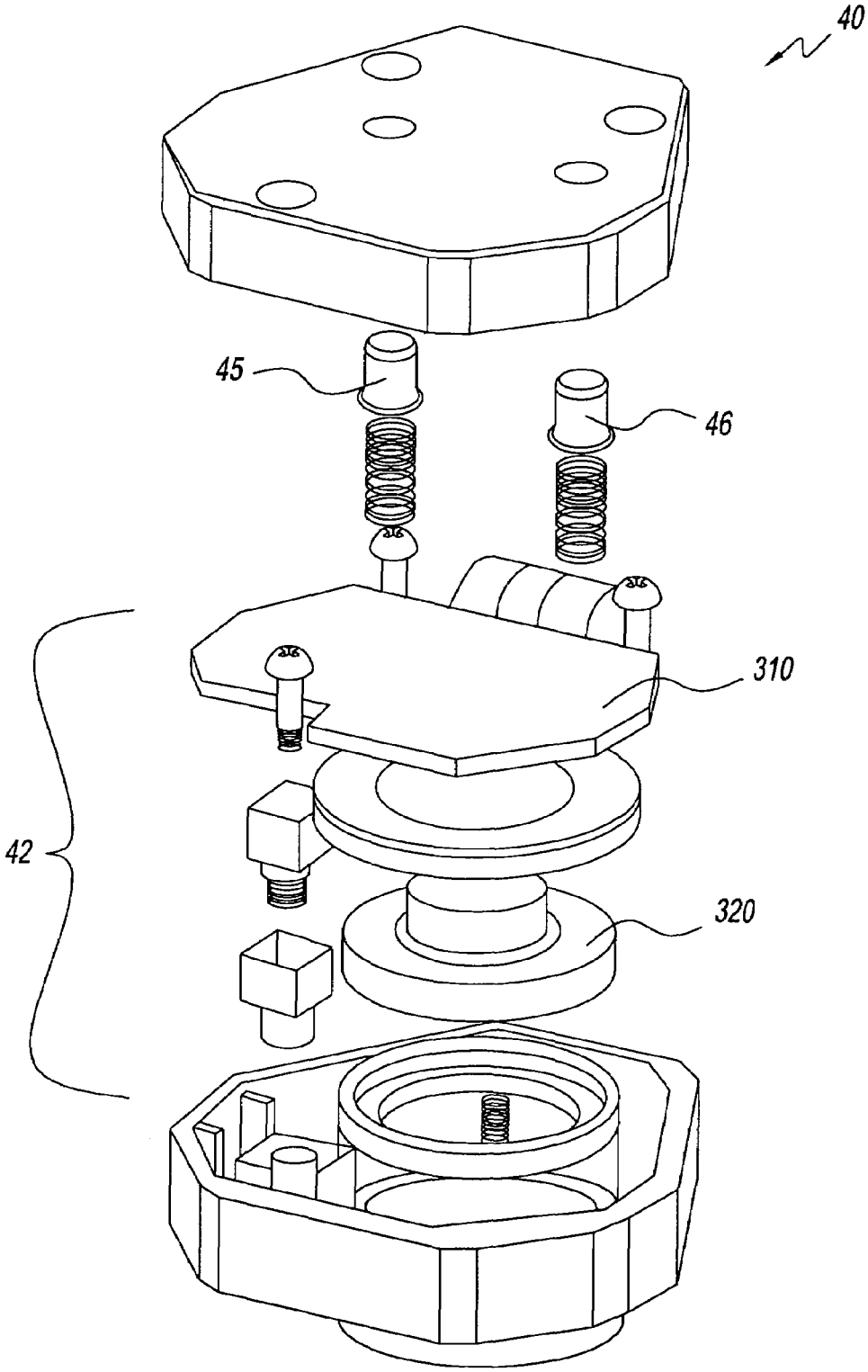
FIG. 11 is a perspective exploded view of the electronics module of FIG. 9.

The graphics 50 are made with conductive ink incorporated into the design. The conductive ink provides an electrical circuit that conducts electricity. Various graphics can be used, such as, for example, the graphics shown in FIG. 2*a*.

Conductive ink lines are printed or otherwise connected to the side of the cup 10. Preferably, there are two conductive ink lines. However, the present invention contemplates the use of any number of conductive ink lines, which can be configured to form various circuits. The conductive ink lines, which is two in the exemplary embodiment, run down the side of the cup and to the bottom of the cup to be connected to an electrical circuit board 300 (or other processing device), which is housed under the cup.

The circuit board 300 has a sound chip 310 and a speaker 320. The present invention also contemplates the use of other sound emitting or creating devices, including devices that provide speech. The speech can also be a recording of the voice of someone that the infant is familiar with. When a person touches his or her finger to a specific point on the graphics 50, the finger bridges or shorts the two conductive ink lines to complete the circuit. By completing the circuit, the circuit board 300 is activated and the sound chip emits a sound. The conductive ink lines are preferably spaced apart a distance that facilitates the bridging or shorting of the lines, such as, for example, smaller than the average size of the width of an infant's finger. The spacing of the lines can be varied.

The cup assembly 10 preferably has components: a cup body 20, a bottom cap assembly 30, the lid 200 and the silicone valve 300 (or other such valving mechanism). The bottom cap assembly 30 has an electronics module 40 housed therein, with the circuit board 300, sound chip 310, batteries and speaker 320.

The cup body or main cup 20 is a vessel that holds the liquid. The cup body 20 also has printing 50 on the side of the cup that includes the conductive ink lines. As described above, any number of conductive ink lines can be utilized so as to form various configurations with one or more interactive circuits. The conductive ink lines are printed on the side and travel down to the bottom of the cup where they connect to the circuit board 300.

The bottom cap assembly 10 (FIG. 6 through 8) stores the electronics module 40 and connects the electronics to the conductive ink. There is an on/Off button 42 on the bottom side of the electronics module 40 so the user can turn off the electronics when not in use. On the top side, there are a pair of contacts 45 and 46 that connect to the two conductive ink lines of the exemplary embodiment, but other numbers of lines and contacts are also contemplated. The bottom cap 30 is removably connected to the main cup using a bayonet thread 22 on the bottom of the cup 20 to mate with posts 32 on the inside of the bottom cap assembly 30. However, the present invention contemplates the use of other connection structures or techniques, such as, for example, snap-fit or threads. The present invention contemplates the bottom cap assembly 30 being removable or permanently connected. In the exemplary embodiment, the bottom cap assembly 30 is removable to avoid people putting the electronics into the microwave or dishwasher.

The electronics module 40 (FIGS. 9 through 11) is a separate module that is secured inside the bottom cap assembly 30. The electronics module 40 stores the circuit board 300, speaker 320, sound chip 320, batteries, electrical contacts 45, 46, on/off button 42 and any other electronics components needed for producing the interactive sounds. The electronics module 40 is preferably made of a non-flammable material, such as, for example, ABS plastic, to prevent problems if, by chance, the user mistakenly puts it in the microwave.

The cup assembly 10 of the exemplary embodiment creates sound. The cup assembly 10 uses the graphics 50 on the side of the cup to actuate the sound emitting device and preferably uses conductive ink to actuate the sound emitting. The removable bottom cap 30 secures the electronics components in a separate piece away from the main cup vessel. Warning labels are preferably engraved into the plastic of the bottom cap 30, and the bottom cap is removable to prevent people from placing it in the microwave or the dishwasher. This is a big advantage to keeping the product safe and long-lasting.

The cup assembly 10 makes an electrical connection using the conductive ink. The lines of conductive ink are printed in circular patterns 57 on the bottom of the cup 20 so they will always make a connection with the electrical contact points 45 and 46 on the top surface of the bottom cap assembly 30 regardless of orientation of the bottom cap. The main cup 20 and bottom cap assembly 30 are easily secured and removed with a bayonet 22 or a thread on the cup and a protrusion 32 on the inside of the bottom cap assembly.

The present invention contemplates the use of other stimuli and combinations of stimuli to be actuated by the graphics and preferably the conductive ink lines of the cup assembly, such as, for example, lights or vibration with or without the sound emitting device. The present invention also contemplates emitting different stimuli, such as, for example, different sounds or different words or sentences, depending upon the point of the graphics where the user presses. Also, the particular stimuli, such as, for example, words, can be alternated by the stimuli emitting devices, such as, for example, a sound chip that varies the sounds emitted. The speech emitted can be recorded. The electronics module can have recording components that facilitates input and storage of the particular speech to be used as stimuli for the infant.

The present invention having been thus described with particular reference to the preferred forms thereof, it will be obvious that various changes and modifications may be made therein without departing from the spirit and scope of the present invention as defined herein.

What is claimed is:

1. A bottle assembly comprising:

a cup having a body with an outer surface and defining a volume, the outer surface having at least two lines of conductive ink thereon, the at least two lines defining graphics; and a bottom portion connected to the body and housing an electronics module connected to the at least two lines, wherein the electronics module emits a stimuli when the at least two lines are simultaneously contacted by a user.

2. The bottle assembly of claim 1, wherein the bottom portion is removably connected to the body.

3. The bottle assembly of claim 1, further comprising a lid removably connected to the body.

4. The bottle assembly of claim 3, further comprising a valve connected to the lid for selectively isolating the volume.

5. The bottle assembly of claim 1, wherein the stimuli is sound.

6. The bottle assembly of claim 5, wherein the sound is speech.

7. The bottle assembly of claim 2, wherein the body has a bottom wall, wherein a portion of the at least two lines are formed in a circular pattern along the bottom wall, and wherein the bottom portion has electrical contacts that contact the circular pattern.

8. The bottle assembly of claim 1, wherein the bottom portion is removably connected to the body via a bayonet connection.

9. The bottle assembly of claim 3, wherein the lid is connected to the body via threads.

10. The bottle assembly of claim 4, wherein the lid has a spout.

11. A bottle assembly comprising:

a cup having a body with an outer surface and defining a volume, the outer surface having at least two lines of conductive ink thereon, the at least two lines defining graphics; and a bottom portion connected to the body and housing an electronics module connected to the at least two lines, wherein the electronics module emits a sound when the at least two lines are simultaneously contacted by a user, and wherein the bottom portion is removably connected to the body.

12. The bottle assembly of claim 11, further comprising a lid removably connected to the body.

13. The bottle assembly of claim 11, further comprising a valve connected to the lid for selectively isolating the volume.

14. The bottle assembly of claim 11, wherein the sound is speech.

15. The bottle assembly of claim 11, wherein the body has a bottom wall, wherein a portion of the at least two lines are formed in a circular pattern along the bottom wall, and wherein the bottom portion has electrical contacts that contact the circular pattern.

16. The bottle assembly of claim 11, wherein the bottom portion is removably connected to the body via a bayonet connection.

17. The bottle assembly of claim 12, wherein the lid is connected to the body via threads.

18. The bottle assembly of claim 13, wherein the lid has a spout.

19. A method of providing stimuli for a child to drink from a bottle assembly, the method comprising:

providing a cup having graphics made from at least two lines of conductive ink that define an open circuit;

closing the circuit by a child's hand when holding the bottle assembly; and emitting the stimuli in response to the closed circuit.

20. The method of claim 19, further comprising recording speech and emitting the speech as the stimuli.

* * * * *